US007373813B2

(12) United States Patent
DiFoggio

(10) Patent No.: US 7,373,813 B2
(45) Date of Patent: May 20, 2008

(54) METHOD AND APPARATUS FOR ION-SELECTIVE DISCRIMINATION OF FLUIDS DOWNHOLE

(75) Inventor: Rocco DiFoggio, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 122 days.

(21) Appl. No.: 11/358,568

(22) Filed: Feb. 21, 2006

(65) Prior Publication Data

US 2007/0193351 A1 Aug. 23, 2007

(51) Int. Cl.
*E21B 47/08* (2006.01)

(52) U.S. Cl. ..... 73/152.55

(58) Field of Classification Search ..... 73/152.23, 73/152.54, 152.55

See application file for complete search history.

(56) References Cited

U.S. PATENT DOCUMENTS

| | | | | |
|---|---|---|---|---|
| 3,890,502 | A * | 6/1975 | Dowling et al. | 250/267 |
| 4,524,324 | A * | 6/1985 | Dickinson, III | 340/856.3 |
| 4,698,500 | A * | 10/1987 | Scala | 250/256 |
| 5,353,637 | A * | 10/1994 | Plumb et al. | 73/152.17 |
| 6,995,899 | B2 * | 2/2006 | Aronstam | 359/333 |
| 7,062,958 | B2 * | 6/2006 | Diakonov et al. | 73/152.23 |
| 2002/0066309 | A1 * | 6/2002 | Tubel et al. | 73/152.54 |
| 2003/0134426 | A1 * | 7/2003 | Jiang et al. | 436/121 |
| 2003/0136673 | A1 | 7/2003 | Pilloud et al. | |
| 2003/0205083 | A1 * | 11/2003 | Tubel et al. | 73/152.19 |
| 2003/0213691 | A1 | 11/2003 | Peper et al. | |
| 2004/0045350 | A1 * | 3/2004 | Jones et al. | 73/152.23 |
| 2005/0092595 | A1 | 5/2005 | Peterson et al. | |
| 2005/0109098 | A1 * | 5/2005 | DiFoggio | 73/152.55 |
| 2005/0133697 | A1 | 6/2005 | Potyrailo et al. | |
| 2005/0191428 | A1 | 9/2005 | Buck | |

OTHER PUBLICATIONS

J.P. Janseens, A.J. Parry, P.J. Van Der Mark, F.J.M. De Vreede, A. Park, M. Wehmaljer, J.M. Wissink, J.A.J. Brunink, H. Leeuwis & D.J.M. Van Mierio, Columbus: A Novel Sensor System for Domestic Washing Machines, Jun. 2002, pp. 1-9.

* cited by examiner

*Primary Examiner*—Hezron Williams
*Assistant Examiner*—John Fitzerald
(74) *Attorney, Agent, or Firm*—G. Michael Roebuck

(57) ABSTRACT

In a particular embodiment, a method is disclosed for determining a source of a fluid downhole. The method includes deploying an ion selective sensor downhole, exposing the fluid to the ion selective sensor downhole, measuring an ion concentration at different places within the fluid and using that information to identify a source of the fluid from the ion concentration profile. In another particular embodiment, an apparatus is disclosed for estimating a source of a fluid. The apparatus contains a tool deployed in a well bore, an ion selective sensor in the tool, a processor in communication with the ion selective sensor and a memory for storing an output from the ion selective sensor.

21 Claims, 3 Drawing Sheets

METHOD AND APPARATUS FOR ION-SELECTIVE DISCRIMINATION OF FLUIDS DOWNHOLE

1. FIELD OF THE DISCLOSURE

The present invention relates to the field of downhole fluid analysis and in particular to the determining a property of a fluid downhole.

2. BACKGROUND INFORMATION

A production log is a well log run in a production or injection well. Small diameter tools are used so that they can be lowered through tubing. In the past, well production services and devices included continuous flow meter, packer flow meter, gradiomanometer, manometer, densimeter, water cut meter, thermometer, radioactive-tracer logs, temperature logs, calipers, casing collar locator, fluid sampler, water entry survey, etc.

A well log can be a wireline borehole log. The product of a survey operation, also called a survey, consisting of one or more curves. Provides a permanent record of one or more physical measurements as a function of depth in a well bore. Well logs are used to identify and correlate underground rocks, and to determine the mineralogy and physical properties of potential reservoir rocks and the nature of the fluids they contain. A well log is recorded during a survey operation in which a sonde is lowered into the well bore by a survey cable.

The measurement made by the downhole instrument will be of a physical nature (i.e., electrical, acoustical, nuclear, thermal, dimensional, etc.) pertaining to some part of the wellbore environment or the well bore itself. Other types of well logs are made of data collected at the surface; examples are core logs, drilling-time logs, mud sample logs, hydrocarbon well logs, etc. Still other logs show quantities calculated from other measurements; examples are movable oil plots, computed logs. etc.

SUMMARY OF THE INVENTION

In a particular embodiment, a method is disclosed for determining a source of a fluid downhole. For example, a producing well often produces both oil and water. Over time, the water production often increases. The additional water may come primarily from only a few perforations in the well casing. This invention provides a means to identify the troublesome perforations so that corrective action can be taken. The method includes deploying an ion specific sensor at a first depth, exposing a first fluid to the ion selective (may also be referred to as ion specific) sensor downhole, measuring an ion concentration at a plurality of positions within the first fluid, and identifying a first fluid source from the ion concentration profile for the fluid.

In another particular embodiment the ion specific sensor further is an ion specific field effect device. In another particular embodiment, the method further includes identifying an increase of an undesirable fluid from the ion concentration and finding a source for the undesirable fluid.

In another particular embodiment, the ion specific sensor selects an ion from the set consisting of potassium, nitrogen and hydrogen. In another particular embodiment, wherein identifying the source of the first fluid further includes measuring an ion concentration for the first fluid from the first fluid source downhole, and locating a source for undesirable fluid from the ion concentration measured for the first fluid source.

In another particular embodiment, the method further includes locating a second fluid source downhole, measuring an ion concentration for a second fluid from a second fluid flow from the second fluid source downhole, and estimating a source for undesirable fluid from the ion concentrations measured for the first fluid source and the second fluid source.

In another particular embodiment, wherein the first fluid is from a first layer in a formation and the second fluid is from a second layer in the formation the method further includes comparing the ion concentration for the first fluid to the ion concentration for the second fluid and estimating compartmentalization for the formation from the comparison. In another particular embodiment, the ion selective sensor further includes a plurality of sensors each displayed at a different depth, and the method further includes estimating a source of a fluid having a particular ion concentration from a plurality of ion concentration measurements made by the plurality of sensors at different depths.

In another particular embodiment, the method further includes detecting a particular ion concentration in the fluid at a first time at a first sensor at a first depth in the array, detecting the particular ion concentration in the fluid at a second time at a second sensor at a second depth in the array, and estimating a fluid velocity from a difference between the first depth and the second depth divided by a difference between the first time and the second time. In another particular embodiment, the method further includes releasing a tracer from one of the plurality of sensors into the fluid having the particular ion concentration. In another particular embodiment, the method further includes measuring the ion concentration further includes measuring a plurality of ion concentrations for the fluid at a single depth and identifying a source of the fluid from the plurality of ion concentrations for the fluid.

In another particular embodiment an apparatus is disclosed for estimating a source of a fluid, the apparatus including a tool deployed in a well bore, an ion selective sensor in the tool, a processor in communication with the ion selective sensor, and a memory for storing an output from the ion selective sensor. In another particular embodiment, the apparatus further includes a perforation locator. In another particular embodiment, the apparatus further includes a tracer release unit.

In another particular embodiment, the method further includes a plurality of tools forming an array of tools, each tool in the array having an ion selective sensor. In another particular embodiment, the ion selective sensor further includes a plurality of ion selective sensors, wherein each of the plurality of ion selective sensors selects a different ion.

In another particular embodiment, the tool is deployed from one of the set consisting of a wireline, coiled tubing and a drill string. In another particular embodiment, the tool is a sampling tool. In another particular embodiment, a method for determining a source of a fluid from a formation downhole is disclosed. The method includes logging ion concentrations for fluids flowing from different formation layers; exposing a fluid to an ion selective sensor downhole; measuring an ion concentration for the fluid; and identifying a source layer in the formation for the fluid from the ion concentration log. In another particular embodiment, the method further includes sealing a perforation associated with the source layer.

Examples of certain features of the invention have been summarized here rather broadly in order that the detailed description thereof that follows may be better understood and in order that the contributions they represent to the art may be appreciated. There are, of course, additional features of the invention that will be described hereinafter.

BRIEF DESCRIPTION OF THE FIGURES

For a detailed understanding of the present disclosure, references should be made to the following detailed description of the illustrative embodiment, taken in conjunction with the accompanying drawings, in which like elements have been given like numerals, wherein.

DETAILED DESCRIPTION OF AN ILLUSTRATIVE EMBODIMENT

Figure 1:
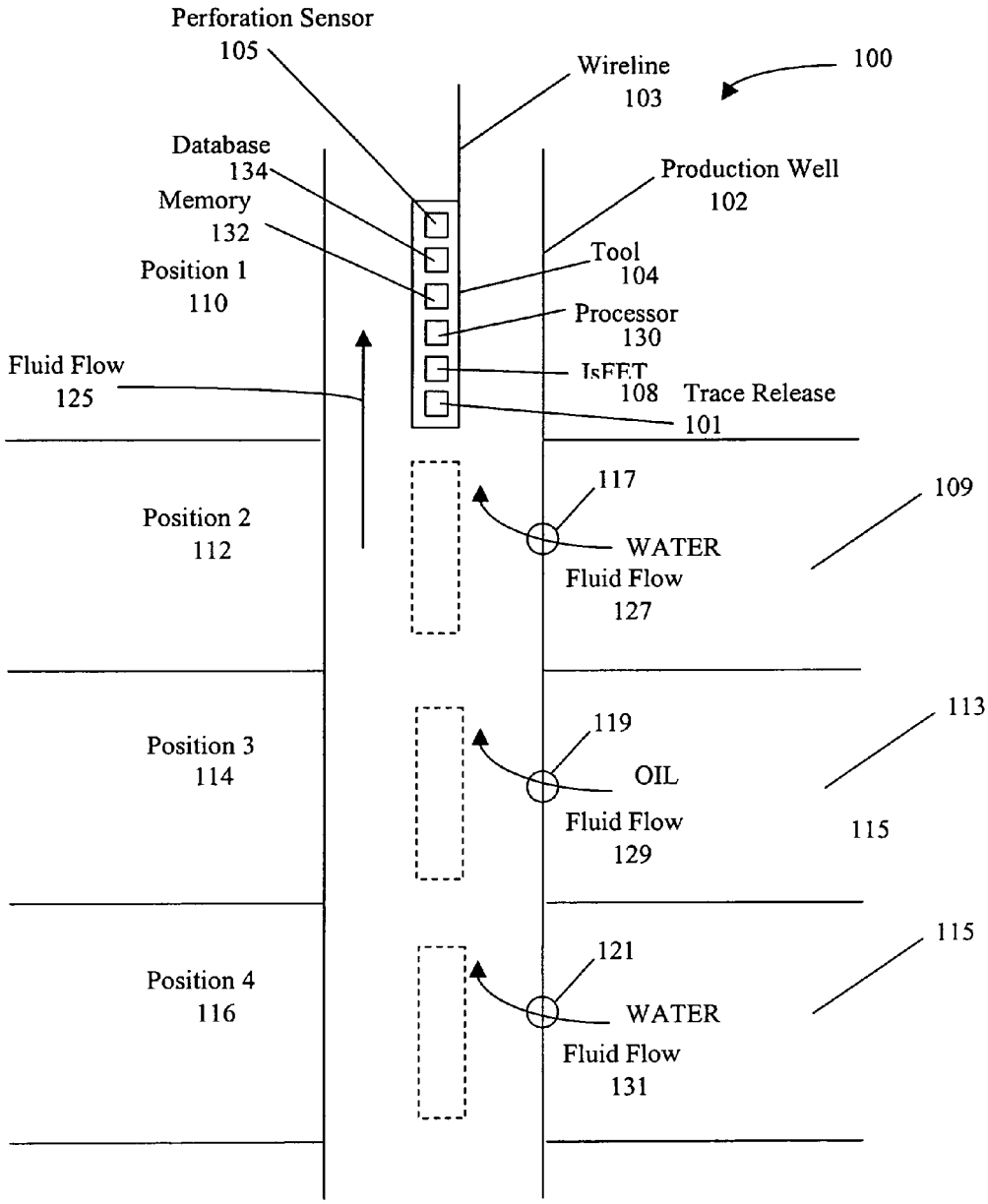
FIG. 1 is a schematic diagram of an illustrative embodiment of a tool containing an ion-sensitive sensor deployed downhole from a wireline at different depths in a production well.

The term "pH" is a symbol used to designate the degree of acidity or alkalinity (basicity) of a water solution. The pH scale measures how acid or alkaline a solution is. The pH is directly related to the ratio of hydrogen ($H^+$) to hydroxyl ($OH^-$) ions present in the solution. The more hydrogen ions that are present, the more acidic the solution. If hydroxyl ions exceed hydrogen ions, the solution is basic, and if the two ions are present in equal amounts, the solution is neutral.

The pH scale ranges from 0 to 14, with the pH of pure water equaling 7.0. Values smaller than 7.0 indicate an increase in hydrogen ions (acidity); numbers larger than 7.0 indicate an increase in alkalinity. Because the scale is logarithmic, a pH of 6.0 represents 10 times more hydrogen ions than are present at pH 7.0, while a pH of 5.0 represents 10 times more hydrogen ions than are present at pH 6.0 and 100 times more hydrogen ions than are present at pH 7.0.

Thus, pH is an expression representing the negative logarithm of the effective hydrogen-ion concentration or hydrogen-ion activity (in gram equivalents per liter). The pH value is a unit of measure of the acid or alkaline condition of a substance. A neutral solution (as pure water) has a pH of 7; acid solutions are less than 7; basic, or alkaline solutions are above 7. The pH scale is a logarithmic scale; a substance with a pH of 4 is ten times as acidic as a substance with a pH of 5. Similarly, a substance with a pH of 9 is ten times more alkaline as a substance with a pH of 8.

Ion selective devices can discriminate between fluids (including gases or liquids) having different ion concentrations of a particular ion. Ion selective field effect transistors (IsFETS) are devices that can be used to measure the concentration of particular ions, for example, ions including but not limited to Na, K or other ions. In an illustrative embodiment an ion selective device, for example, including but not limited to an IsFET is provided as that is used along with a processor, memory and data base to distinguish between ion concentrations of fluids in the a production well. The fluids combine into a combined flow containing fluids that are flowing from perforations in the production well. Ion sensitive sensors enable distinction of one ion selective fluid from other fluids flowing up the center of the production well. The ion selective sensor, in an illustrative embodiment, an IsFET enables measurement of ion concentrations in the fluids in the production well. A processor, memory and data base are associated with the IsFET and housed in a tool. The combination of the ion selective sensor, processor and memory distinguishes differences in particular ion concentrations of the fluids flowing in the well bore or production well. An array of IsFETS can be used to determine fluid velocity by comparison or cross correlation of their responses.

In an illustrative embodiment, a particular ion is selected for monitoring downhole, for example, K or Na. An ion selective sensor, for example, an IsFET device is lowered to different depths into a production well and ion concentration measurements made at each depth. In an alternative embodiment, an array of ion selective sensors, for example, an array of IsFET devices is placed into a producing well, each IsFET device in the array being deployed at a different depth. The depths of the single device or deployment depths of devices in the array can be selected to correspond with perforations in the well bore. The perforations may correspond to different layers in the formation. Each IsFET device in the array is attached to a wireline at a different depth. A perforation locator, well known in the art, is also attached to the wireline or incorporated into the tool help find perforations in the wellbore casing. Perforation location enables locating the ion selective sensor, the IsFET adjacent a perforation for measurement to determine from which perforation a particular fluid having a particular ion concentration is coming.

A measurement is made for the ion concentrations at each depth associated with a perforation. The measurement is made by an individual ion selective sensor or by an array of ion selective sensors, such as an array of IsFET devices. An illustrative embodiment uses these ion concentration measurements to distinguish between fluids, such as between two or more waters (typically brines) based on ion concentration differences. The ion concentration differences help to estimate which perforations are producing most of this water so that the perforation from which the unwanted fluid is coming can be shut off. Shutting off these perforations can save huge costs of producing brine and then having to dispose of unwanted brine.

Ion-specific field effect transistors can be used as ion selective devices to determine pH or other ion concentrations of fluids such as water in a production well. pH can be defined as =−10 Log 10 (Hydrogen Ion Concentration) and similarly pNa=−10 log 10 (Sodium Ion Concentration) and pK=−10 log 10 (Potassium Ion Concentration). The IsFET devices can be used to measure ion concentrations to distinguish between one formation brine from another formation brine to distinguish formation waters that have come from different zones (layers) in the formation.

In a particular embodiment, pH can be measured with an ion selective field effect transducer form MESA+Research Institute of the University of Twente and a commercially available thick film miniaturized silver/silver chloride reference electrode. A linear temperature correction can be used for the ISFET/reference electrode system.

Turning now to FIG. 1 an illustrative embodiment is shown deployed in a production well. In other embodiments, the IsFET device or ion-sensitive sensor can be deployed from a wireline, coiled tubing or a drill string in an open well or during monitoring while drilling. As shown in FIG. 1, an illustrative embodiment 100 is depicted deployed in a production well 102. A tool 104 is deployed in a production well 102 from wireline 103. The tool 104 contains a processor 106 and an ion sensitive device, such as an ion sensitive field effect transistor (IsFET) 108, memory 132, database 134 and perforation locator 105. A tracer release unit 101 for release of a fluid having an ion concentration detectable by the ion sensitive sensor 108 is contained in the tool 104. The IsFET device is small approximately 1 $mm^2$ surface area on a side. Thus an array of IsFETs can be easily located in a single tool. The small devices are also low mass and thus resistant to vibration.

The production well 102 penetrates a formation consisting of different layers 109, 113 and 115. These layers may each have a different characteristic that affects the ion concentration that may vary over time. For example, during a particular time period all three formation layers 109, 113 and 115 may produce oil. After a period of time and after significant production, layers 109 and 115 may produce water or brine and layer 113 produce predominantly oil. The tool 104 can be positioned adjacent each perforation 117, 119 and 121 to determine the ion concentration for fluids flowing from the formation layer adjacent the perforation.

Tool 104 contains ion sensitive device 108, processor and memory 106. The processor takes digital samples of ion sensitive sensor data from the ion sensitive sensors in the ion sensitive device and stores the samples in processor memory. Processor memory may further include a data base in memory. The memory may include an embedded computer readable medium containing instructions that when executed by the processor perform the method and functions described herein.

When the tool 104 is in position 1 110, the ion sensitive sensor 108 senses the ion concentration, that is a count for a particular ion per unit volume, for fluid flow, for example, brine, water and oil from all three regions in the formation 109, 113 and 115. In an illustrative embodiment the water/oil mixtures from each of the three production zones 109, 113 and 115 are intermingled and sensed by the tool 111 at position 110. In the position 110 the tool housing the ion sensitive field effect transistor 108 can sense the ion concentrations of the combined fluids flowing in the production well. The processor 106 is utilized to control the ion sensitive field effect transistor 108 and to process measurements of ion concentrations sensed by the IsFET 108.

In an illustrative example scenario, consider that at position 110 the processor analyzes measurements from the ion sensitive sensor 108 in the tool and determines from an increase in the ion concentration of the combined flow 125, that an unacceptable increase in the flow of hydrogen ion brine is present in the combined fluid flow 125 in the well 102. Fluid flow 125 represents the combined fluid flow including fluid flow 127 from perforation 117, fluid flow 129 from perforation 109 and fluid flow 131 from perforation 121. The well operator wants to find the source of or the perforation in the well bore casing leading to the layer that is the source of the excess hydrogen ion brine and seal off that perforation. The well operator may rather seal off the perforation that is producing the undesirable excess brine and than to have to dispose of the hydrogen ion brine after it has been brought to the surface.

The fluid flows through perforations 117, 119 and 121 from formation layers 109, 113 and 115 respectively. In position 2 112 the ion sensitive device 108 in tool 104 senses flow 127 predominantly from perforation 117 formed in formation layer 109. In position 3 114 the ion sensitive device 108 in tool 104 senses flow 129 predominantly from perforation 119 formed in formation layer 115. In position 4 116 the ion sensitive device 108 in tool 104 senses flow 131 predominantly from perforation 121 formed in the production well associated with formation layer 115.

In an illustrative embodiment the tool in position 1 senses an undesirable excess or increase in flow of a fluid, such as brine with a hydrogen ion concentration and thus seeks to determine which perforation 117, 119 or 121 from which the increased flow of water having a hydrogen concentration originates. Lowering the tool to position 2 the ion sensitive device, in an illustrative embodiment an IsFET senses the ion concentration associated with the flow 127 from perforation 117. In position 117 it can be determined whether or not the flow 127 from perforation 117 formed in production formation zone 109 is predominantly the hydrogen ion concentration which is producing the undesirable excess flow. In position 3, 114 the ion sensitive device 108 in tool 104 senses predominant production flow 129 from perforation 119 and is able to determine whether the flow 129 from formation layer 113 is predominantly the source of the undesirable excess hydrogen ion brine. In position 4 116 the ion sensitive device 108 in tool 104 senses the flow 131 predominantly from perforation 121 and thus can determine if the predominantly hydrogen flow is originating from formation layer 115.

Once the source perforation of the undesirable excess hydrogen ion brine or fluid flow having high hydrogen ion concentration is identified it can associated with one of the three perforations. The perforation from which the undesirable excel flow is coming, can then be sealed off to stop the flow of hydrogen ion brine or fluid from that perforation. Sealing off the perforation reduces the amount of water in the fluid produced from the formation.

In an illustrative embodiment the brines or salty water from each of the formation layers can be identified by their ion concentration and thus differentiated as to their source from one of the three perforations 117, 119 and 121. In an illustrative embodiment the perforations 117, 119 and 121 are separated by 30-50 feet. Over this distance of 30-50 feet between perforations the brines are likely to have different ion compositions. Brines, however, might have roughly the same resistivity thus a resistivity measurement of the brines would not differentiate between them. The small composition of difference between the brines coming from each perforation helps to identify where the increased water in the production fluid is coming from. Perforation locations can be sensed by numerous methods well known in the art such as a pin wheel spinning more rapidly nearer a perforation indicating an increased flow.

In an alternative embodiment, the ion concentrations are sensed for each depth, perforation and/or layer during monitoring while drilling or during wireline operations in an open well before production and logged in an ion concentration log for future reference. Thus, when a particular ion concentration appears in excess in a production well, the ion concentration log can be referenced to determine which perforation associated with a particular layer is the source of the excess ion concentration. The perforation contributing to the excess ion concentration can then be sealed.

In another particular embodiment a sampling tool including an ion sensitive sensor may be used in an open hole to take samples of different zones in the formation thereby determining their ion concentrations for reference later in production to be associated with ion concentration measurements from ion sensitive devices, such as IsFETS. These ion concentration measurements help to determine the location of perforation that needs to be filled due to an increased flow of undesirable fluid, such as brine from that particular perforation. The measurements can also be taken during monitoring while drilling logs in which a sampling tool could sample the brine zones or the ion concentrations associated with particular zones in the formation.

Figure 2:
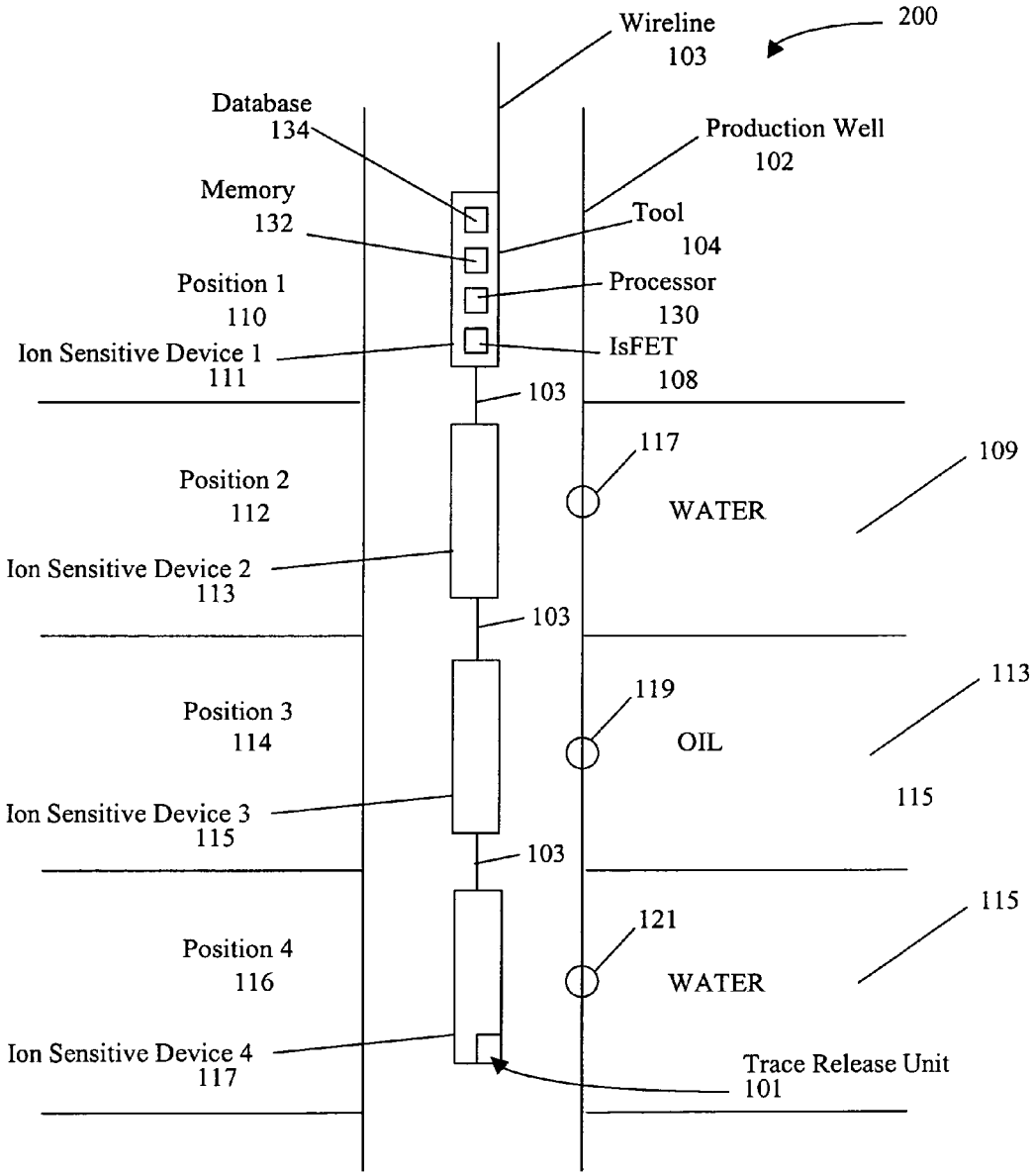
FIG. 2 is a schematic diagram of an illustrative embodiment of an array of ion-sensitive sensors deployed downhole from a wireline in a production well.

Turning now to FIG. 2, in another particular illustrative embodiment, an array 200 ion selective sensors, in the illustrative example, IsFETs 111, 113, 115 and 117, is deployed in the production well. The ion concentration measurements between the ion sensitive devices 111, 113, 115 and 117 in the array can be compared and cross correlated to determine or estimate fluid velocity. A particular ion concentration can be tracked between array sensors to determine the velocity of a fluid having a particular ion concentration. The fluid velocity in the production well can be estimated as roughly equivalent to the fluid velocity of the particular ion concentration fluid. For example, a predominantly heavy ion concentration may be detected at the bottom most ion sensitive sensor 117 at a particular time, t1. Later, at time t2 the same ion predominantly heavy ion concentration may be detected at the next lowest ion sensitive sensor 115. Later, at time t3 the same predominantly heavy ion concentration may be detected at the next lowest ion sensitive sensor 113. Later, at time t4 the same predominantly heavy ion concentration may be detected at the highest ion sensitive sensor 111. Fluid velocity may be determined from the amount of time it takes for the ion sensitive ion concentration to flow between ion sensitive sensors divided by the distance between the sensors.

In another embodiment, a tracer having a specific ion concentration detectable by the ion sensitive sensors can be released from the bottom most tool housing ion sensitive sensor 117. The fluid velocity of the fluid in the production well can then be determined as described above from the amount to time it takes for the tracer to flow between ion selective sensors divided by the distance between the ion selective sensors.

Figure 3:
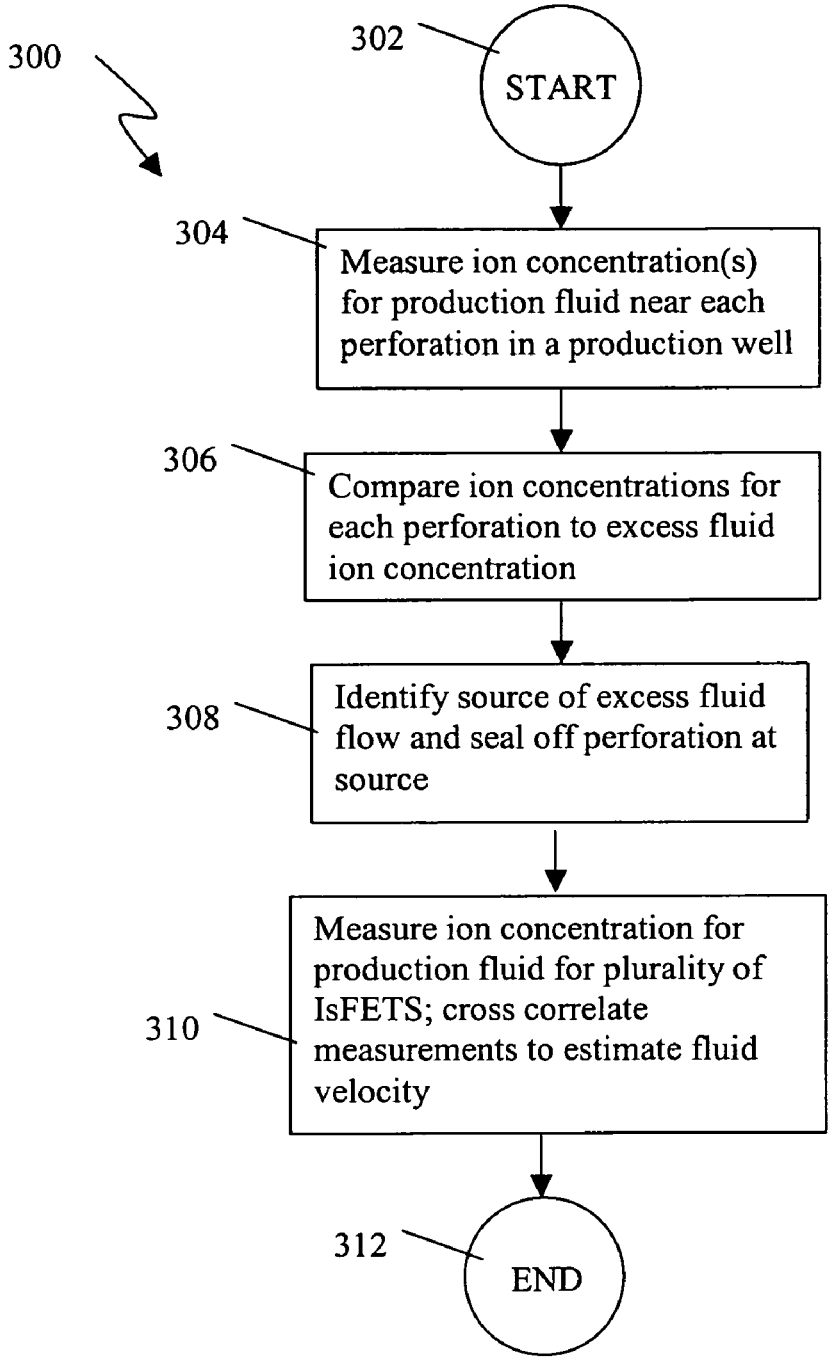
FIG. 3 is a flow chart for functions performed in an illustrative embodiment.

Turning now to FIG. 3 a flow chart of a method in an illustrative embodiment is provided. As shown in FIG. 3 an illustrative embodiment 300 is depicted in measuring ion concentrations starting at different levels in a well bore such as a production well at block 302. The depth or location for each perforation is determined or found by perforation locator 105 in the wellbore. An ion concentration is measured near each perforation by ion sensitive sensor 108 and a data sample of the measurement is taken by processor 106. The data sample is stored in a memory 132 or a database 134 in memory 132 for production fluid near each perforation. The ion concentration for each perforation is compared to an excess fluid ion concentration at 306. The source perforation of excess fluid flow is identified and the source perforation can be sealed off at block 308. The ion concentration for a tracer or a fluid having a particular ion concentration is measured for an array of ion sensitive sensors, for example, IsFETs. The time required for the ion selective concentration (which can be a formation fluid or a tracer injected by the tool in the well fluid flow) to travel between ion sensors in the array is measured and divided by the distance between the ion sensitive sensor to determine fluid velocity at block 310. The procedure ends at 312.

In another embodiment, an array of ion selective sensors, for example IsFETs is provided in each tool. Each IsFET is selected to sense a different ion. Thus, a multiplicity of ion sensitive measurements for a multiplicity of ions can be made in a single tool at each depth.

While the foregoing disclosure is directed to the exemplary embodiments of the invention various modifications will be apparent to those skilled in the art. It is intended that all variations within the scope of the appended claims be embraced by the foregoing disclosure. Examples of the more important features of the invention have been summarized rather broadly in order that the detailed description thereof that follows may be better understood, and in order that the contributions to the art may be appreciated.

The invention claimed is:

1. A method for estimating a source of a fluid downhole, comprising:

deploying an ion specific sensor at a first depth;

exposing a first fluid to the ion specific sensor downhole;

measuring an ion concentration for a first fluid at a first depth; and identifying the source from the ion concentration.

2. The method of claim 1, wherein the ion specific sensor further comprises an ion specific field effect device.

3. The method of claim 1, further comprising:

identifying an increase of an undesirable fluid from the ion concentration; and finding a source for the undesirable fluid.

4. The method of claim 1, wherein the ion specific sensor selects an ion from the set consisting of potassium, nitrogen and hydrogen.

5. The method of claim 1, wherein measuring the ion concentration further comprises:

measuring a plurality of ion concentrations for the fluid at a single depth; and identifying a source of the fluid from the plurality of ion concentrations for the fluid.

6. The method of claim 1, further comprising:

measuring ion concentrations for fluids flowing from different layers in a formation.

7. The method of claim 6, further comprising:

sealing a perforation associated with the source layer.

8. The method of claim 1, wherein identifying the source of the first fluid further comprises:

measuring an ion concentration for the first fluid from the first fluid source downhole; and locating a source for undesirable fluid from the ion concentration measured for the first fluid source.

9. The method of claim 8, further comprising:

locating a second fluid source downhole;

measuring an ion concentration for a second fluid from a second fluid flow from the second fluid source downhole; and estimating a source for undesirable fluid from the ion concentrations measured for the first fluid source and the second fluid source.

10. The method of claim 9, wherein the first fluid is from a first layer in a formation and the second fluid is from a second layer in the formation, the method further comprising:

comparing the ion concentration for the first fluid to the ion concentration for the second fluid; and estimating compartmentalization for the formation from the comparison.

11. The method of claim 1, wherein the ion selective sensor further comprises a plurality of sensors each displayed at a different depth, the method further comprising:

estimating a source of a fluid having a particular ion concentration from a plurality of ion concentration measurements made by the plurality of sensors at different depths.

12. The method of claim 11, further comprising:

detecting a particular ion concentration in the fluid at a first time at a first sensor at a first depth in the array;

detecting the particular ion concentration in the fluid at a second time at a second sensor at a second depth in the array; and estimating a fluid velocity from a difference the first depth and the second depth divided by a difference between the first time and the second time.

13. The method of claim 12, further comprising:

releasing a tracer from one of the plurality of sensors into the fluid having the particular ion concentration.

14. A system for estimating a source of a fluid comprising:

a wellbore; and a tool having an ion selective sensor deployed in a location within the well bore, the tool further comprising a perforation locator; a processor in communication with the ion selective sensor; and a memory for storing an output from the ion selective sensor.

15. The system of claim 14, further comprising:

a tracer release unit.

16. The system of claim 14, wherein the tool comprises a plurality of tools forming an array of tools, each tool in the array having an ion selective sensor.

17. The system of claim 14, wherein the ion selective sensor further comprises a plurality of ion selective sensors, wherein each of the plurality of ion selective sensors selects a different ion.

18. The system of claim 14, wherein the tool is deployed from one of the set consisting of a wireline, coiled tubing and a drill string.

19. The system of claim 18, wherein the tool is a sampling tool.

20. An apparatus for estimating a source of an undesirable fluid in a well bore, the apparatus comprising:

a tool deployed in the well bore, the tool having an ion selective sensor for measuring an ion concentration for a first fluid at a first depth in the borehole, the tool further comprising a processor in communication with the ion selective sensor;

a memory for storing an output from the ion selective sensor; and a computer program embedded in a computer readable medium containing instructions that when executed by the processor estimate the source of the undesirable fluid from the ion concentration.

21. The apparatus of claim 20, the computer program further comprising:

instructions to locate a second fluid source downhole, instructions to measure an ion concentration for a second fluid from a second fluid flow from the second fluid source downhole and instructions to estimate the source of the undesirable fluid from the ion concentrations measured for the first fluid source and the second fluid source.

* * * * *